United States Patent [19]

Nakagawa et al.

[11] 3,979,313

[45] Sept. 7, 1976

[54] BLEACHING COMPOSITION

[75] Inventors: Yunosuke Nakagawa, Koshigaya; Shigetsugu Sugiura, Tokyo; Kinjiro Matsunaga, Funabashi; Yoshio Ito, Kohriyama, all of Japan

[73] Assignees: Kao Soap Co., Ltd.; Nippon Peroxide Co., Ltd., both of Tokyo, Japan

[22] Filed: July 7, 1975

[21] Appl. No.: 593,201

[30] Foreign Application Priority Data

Oct. 3, 1974 Japan ..... 49-114129

[52] U.S. Cl. ..... 252/99; 252/94; 423/476; 423/513; 423/582

[51] Int. Cl.[2] ..... C11D 7/54; C11D 7/18; C11D 7/56

[58] Field of Search ..... 252/99, 94; 423/513, 423/476, 582

[56] References Cited

UNITED STATES PATENTS

| | | | |
|---|---|---|---|
| 3,663,444 | 5/1972 | Schmadel | 252/99 |
| 3,715,184 | 2/1973 | Kuhling et al. | 252/99 |

*Primary Examiner*—Mayer Weinblatt
*Assistant Examiner*—Edith R. Buffalow
*Attorney, Agent, or Firm*—Woodhams, Blanchard and Flynn

[57] ABSTRACT

A bleaching composition comprising a hydrogen peroxide adduct having the formula:

$$4Na_2SO_4 \cdot 2H_2O_2 \cdot NaCl$$

and an activating agent.

9 Claims, No Drawings

BLEACHING COMPOSITION

BACKGROUND OF THE INVENTION

1. Field of the Invention

This invention relates to a bleaching composition comprising a hydrogen peroxide adduct and an activating agent.

2. Description of the Prior Art

Various hydrogen peroxide adducts have heretofore been used as bleaching agents, such as, for example, sodium perborate, sodium percarbonate, sodium peroxypyrophosphate, peroxyurea and the like. Especially, sodium perborate and sodium percarbonate are widely used as ingredients of detergents compositions. Activating agents are often used in combination with these bleaching agents for increasing the effects of the bleaching agents at the time of use. When combinations of a hydrogen peroxide adduct and an activating agent are used as household bleaching agents, it is desired to employ them in the form of compositions comprising both components admixed in advance, rather than as two components which are added separately. However, in these compositions, decomposition of the active ingredients is caused not only in the case of an aqueous solution, but also in the case of a powdery composition if only a minute amount of water is present, and the water formed by such decomposition further promotes and accelerates the decomposition. Therefore, it has been very difficult to store such compositions in a stable condition. As means for solving this problem of storage instability, there have heretofore been proposed various methods for reducing the contact between a hydrogen peroxide adduct and an activating agent, for example, a method comprising coating one or both of the two ingredients with a film-forming substance and a method comprising increasing the particle sizes of both ingredients. However, no completely satisfactory result has been obtained by any of these conventional methods.

One of us previously proposed a novel hydrogen peroxide adduct having the formula:

$$4Na_2SO_4 \cdot 2H_2O_2 \cdot NaCl$$

SUMMARY OF THE INVENTION

We have discovered that this hydrogen peroxide adduct can be stored stably in a powdery form in the presence of an activating agent.

More specifically, in accordance with this invention, there is provided a bleaching composition comprising a mixture of hydrogen peroxide adduct having the formula:

$$4Na_2SO_4 \cdot 2H_2O_2 \cdot NaCl \qquad (I)$$

and an activating agent.

The hydrogen peroxide adduct of the structure $4Na_2SO_4 \cdot 2H_2O_2 \cdot NaCl$ used in this invention is an adduct synthesized by reacting sodium sulfate with hydrogen peroxide in an aqueous solution, said method being characterized in that sodium chloride is made present in the reaction system.

The synthesis of this hydrogen peroxide adduct is described in the specification of Japanese Pat. application No. 10208/74, filed Jan. 25, 1974, corresponding to U.S. Ser. No. 593,202 filed July 7, 1975 filed in the names of Ito and Mashiko, and entitled "Stable Sodium Sulfate-Hydrogen Peroxide-Sodium Chloride Adduct and Process for Preparing Same," the entire contents of which are incorporated herein by reference.

As the activating agent used in the bleaching composition according to this invention, there can be mentioned those capable of reacting with hydrogen peroxide in an aqueous solution and thus forming an organic peracid, for example, O-acylated products such as glucose pentaacetate, octa-acetylated sucrose, triacetin, acetoxybenzenesulfonates and triacetylcyanurate, N-acylated products such as tetraacetylethylenediamine and tetraacetylglycoluril, and acid anhydrides such as phthalic anhydride and succinic anhydride, and mixtures of activating agents.

The mixing ratio of the activating agent to the hydrogen peroxide adduct of formula (I), $4Na_2SO_4 \cdot 2H_2O_2 \cdot NaCl$, is not critical in this invention, but in general, the mixing ratio of activating agent/adduct is from 99/1to 1/99, preferably from 7/3 to 1/20, parts by weight.

The bleaching composition of this invention can further contain, if necessary, a water-soluble clothes washing surfactant, water-soluble inorganic or organic builders and fillers, a pigment, a dye, a fluorescent dye, a perfume, a germicide, an antifungal agent and like conventional bleaching composition adjuncts.

In the bleaching compositions of this invention the sum of the above bleaching agent of formula (I) plus the activator, is from about 20 to about 100% by weight, preferably from 25 to 70% by weight.

The other components of the bleaching composition of this invention are chosen from the components customarily used in clothes washing detergent compositions. For example, the remaining components of the composition can be the following:

| | |
|---|---|
| Surfactant | 0 to about 10% by weight, preferably 3 to 7% by weight |
| Neutral Inorganic Salt | 0 to about 80% by weight, preferably 10 to 70% by weight |
| Alkaline Inorganic Builder Salt | 0 to about 30% by weight, preferably about 10 to 20% by weight |
| Organic Builder | 0 to about 10% by weight |
| Optional additive substances, such as perfume, pigment, dye, sterilizer, fluorescent dye, etc. | 0 to about 3% by weight |

As the surfactant, there can be employed, for example conventional anionic clothes washing surfactants such as alkyl sulfates containing an alkyl group having 10 to 22 carbon atoms, soaps containing an alkyl group having 10 to 22 carbon atoms, alkylsulfonates containing 10 to 22 carbon atoms, alkylbenzenesulfonates containing an alkyl group having 10 to 22 carbon atoms, alkylphenylpolyoxyalkylene ether sulfates containing an alkyl group having 8 to 22 carbon atoms, alkylpolyoxyalkylene ether sulfates containing an alkyl group having 10 to 22 carbon atoms, isothionates of fatty acids containing a hydrocarbon chain having 10 to 22 carbon atoms and monoglyceride sulfates of fatty acids having 10 to 22 carbon atoms; conventional nonionic clothes washing surfactants such as polyoxyalkylenealkyl ethers containing an alkyl group having 10 to 22 carbon atoms, polyoxyalkylenealkylphenyl ethers containing an alkyl group having 10 to 22 carbon atoms, alkylolamides of fatty acids containing a carbon chain having 10 to 22 carbon atoms, polyoxyethylenesorbitan esters of fatty acids having 8 to 22 carbon atoms, polyethyleneglycol-fatty acid esters having a carbon chain of 8 to 22 carbon atoms and polyoxypropylene-polyoxyethylene block copolymers; and amphoteric surfactants such as alkylbetaines containing an alkyl group having 8 to 22 carbon atoms and ethoxybetaine. These surfactants can be used singly or in the form of mixtures of two or more of them. Cationic surfactants can be used according to need.

The neutral inorganic builder or filler salt used in the bleaching composition of this invention includes neutral watersoluble inorganic salts such as sodium sulfate and sodium chloride, and the use of sodium sulfate is especially preferred.

Conventional alkaline detergent builders such as salts of condensed phosphoric acids such as tripolyphosphoric acid and pyrophosphoric acid, orthophosphoric acid salts, bicarbonates and silicates can be used. Sodium tripolyphosphate and sodium pyrophosphate are preferred.

Likewise, there can be employed in the bleaching composition, conventional organic builders such as ethylenediamine-tetraacetic acid, its salts, nitrilotriacetic acid, its salts, carboxymethyl cellulose, polyethylene glycol, tartaric acid salts and citric acid salts.

The bleaching composition of this invention is stable even if it is stored for a long time. It can be used to bleach and sterilize various clothes and it can also be used broadly as a germicide and as a oxidant.

This invention will now be described in detail by reference to the following illustrative Examples.

EXAMPLE 1

Glucose pentaacetate was mixed with various hydrogen peroxide adducts listed in Table 1 at a mixing weight ratio of 20/80, and the mixture was passed through a 16-mesh sieve and a 60-mesh sieve. The particles left on the 60-mesh sieve were collected. The particles were stored for 1 month at a temperature of 40°C and a relative humidity of 80%, and the residual ratio of available oxygen was measured. The term "available oxygen residual ratio (%)" means $$\frac{\text{available oxygen concentration after storage}}{\text{initial available oxygen concentration}} \times 100$$

The results shown in Table 1 were obtained.

Table 1

| Hydrogen Peroxide Adduct | Initial Available Oxygen Concentration(%) | Available Oxygen Concentration(%) after One Month's Storage | Available Oxygen Residual Ratio(%) |
|---|---|---|---|
| Product of This Invention | | | |
| $4Na_2SO_4.2H_2O_2.NaCl$ | 3.44 | 2.24 | 65 |
| Comparative Products | | | |
| Sodium Percarbonate ($Na_2CO_3.3/2H_2O_2$) | 11.6 | 0 | 0 |
| Sodium Perborate ($NaBO_2.H_2O_2.3H_2O$) | 8.35 | 0 | 0 |
| Sodium Peoxypyrophosphate ($Na_4P_2O_7.H_2O_2$) | 4.25 | 0 | 0 |
| Peroxyurea ($(NH_2)_2CO.H_2O_2$) | 13.30 | 0 | 0 |
| Sodium Peroxysulfate ($Na_2SO_4.1/2H_2O_2$) | 3.98 | 0 | 0 |

EXAMPLE 2

| | |
|---|---|
| $4Na_2SO_4.2H_2O_2.NaCl$ | 50 % |
| Tetraacetylglycoluril | 5 % |
| Sodium Dodecylsulfate | 5 % |
| Sodium Sulfate | 30 % |
| Sodium Tripolyphosphate | 10 % |

The above components were compounded to obtain a bleaching composition. When this composition was stored at 30°C for 1 month, the available oxygen residual ratio was found to be 95%.

EXAMPLE 3

| | |
|---|---|
| $4Na_2SO_4.2H_2O_2.NaCl$ | 20 % |
| Phthalic anhydride | 5 % |
| Sodium Sulfate | 70 % |
| Polyoxyethylene(15)-nonylphenyl ether | 5 % |

The above components were compounded to obtain a bleaching composition. When this composition was stored at 30°C for 1 month, the available oxygen residual ratio was found to be 96%.

EXAMPLE 4

| | |
|---|---|
| $4Na_2SO_4.2H_2O_2.NaCl$ | 60 % |
| Tetraacetylethylenediamine | 10 % |
| Sodium Pyrophosphate | 20 % |
| Sodium Sulfate | 10 % |

It was found that a bleaching composition comprising the above components is stable for a long time and valuable as a bleaching agent for household uses.

EXAMPLE 5

Bleaching compositions A, B, C and D indicated below were prepared.

| | Composition A (Comparison) | Composition B | Composition C | Composition D |
|---|---|---|---|---|
| $4Na_2SO_4.2H_2O_2.NaCl$ | 50 % | 50 % | 50 % | 50 % |
| Glucose Pentaacetate | 0 % | 3 % | 5 % | 10 % |
| Sodium Tripolyphosphate | 10 % | 10 % | 10 % | 10 % |

-continued

| | Composition A (Comparison) | Composition B | Composition C | Composition D |
|---|---|---|---|---|
| Glauber's Salt | 40 % | 37 % | 35 % | 30 % |

A black tea-stained cloth was immersed for 30 minutes in an aqueous solution containing 1 wt.% of the sample composition and maintained at 40°C. Then, the bleached cloth was washed with service water, air-dried and ironed. Then, the reflectivity of the cloth was measured by using an automatic-recording color-different meter, and the bleaching power was calculated according to the following formula:

Bleaching Power = (reflectivity of bleached cloth at 550 m$\mu$) − (reflectivity of stained cloth at 550 m$\mu$)

The reflectivity of the starting stained cloth at 550 m$\mu$ was adjusted at 42 ± 1%. Results obtained are as shown in Table 2.

Table 2

| Bleaching Composition | Bleaching Powder |
|---|---|
| A (Comparison) | 10.5 |
| B (This Invention) | 25.8 |
| C (This Invention) | 34.3 |
| D (This Invention) | 35.0 |

In the foregoing Examples, all references to "%" mean percent by weight unless otherwise indicated.

The embodiments of the invention in which an exclusive property or privilege is claimed are defined as follows:

1. A bleaching composition consisting essentially of from about 20 to about 100 percent by weight of a mixture of 1. $4Na_2SO_4 \cdot 2H_2O_2 \cdot NaCl$, and
2. an activating agent capable of reacting with hydrogen peroxide in aqueous solution to form an organic peracid, wherein the weight ratio of (2) / (1) is from 99/1 to 1/99, from zero to about 10 percent by weight of water-soluble anionic surfactant, or water-soluble nonionic surfactant or mixtures thereof, from zero to about 80 percent by weight of water-soluble neutral inorganic detergent builder or filler salt, from zero to about 30 percent by weight of water-soluble alkaline inorganic detergent builder salt, and from zero to about 10 percent by weight of water-soluble organic detergent builder.

2. A bleaching composition as claimed in claim 1 in which said activating agent is selected from the group consisting of glucose pentaacetate, octa-acetylated sucrose, triacetin, acetoxybenzenesulfonates, triacetylcyanurates, tetraacetylethylenediamine, tetraacetylglycoluril, phthalic anhydride, succinic anhydride and mixtures thereof.

3. A bleaching composition as claimed in claim 2 in which the weight ratio of (2) / (1) is from 7/3 to 1/20.

4. A bleaching composition as claimed in claim 3 containing from 25 to 70% by weight of the sum of component (1) and component (2) and from 10 to 70% by weight of sodium sulfate, as said watersoluble neutral inorganic salt.

5. A bleaching composition as claimed in claim 1 containing from 10 to 20% by weight of sodium tripolyphosphate or sodium pyrophosphate, or mixtures thereof, as said water-soluble alkaline inorganic detergent builder salt.

6. A bleaching composition as claimed in claim 5 containing from 10 to 20% by weight of sodium tripolyphosphate or sodium pyrophosphate, or mixtures thereof, as said water-soluble alkaline inorganic detergent builder salt.

7. A bleaching composition as claimed in claim 1 containing from 3 to 7% by weight of said surfactant.

8. A bleaching composition as claimed in claim 7 containing from 25 to 70% by weight of the sum of component (1) and component (2) and from 10 to 70% by weight of sodium sulfate, as said watersoluble neutral inorganic salt.

9. A bleaching composition as claimed in claim 8 containing from 10 to 20% by weight of sodium tripolyphosphate or sodium pyrophosphate, or mixtures thereof, as said water-soluble alkaline inorganic detergent builder salt.

* * * * *

UNITED STATES PATENT AND TRADEMARK OFFICE

CERTIFICATE OF CORRECTION

PATENT NO. : 3 979 313

DATED : September 7, 1976

INVENTOR(S) : Yunosuke NAKAGAWA, Shigetsugu SUGIURA, Kinjiro MATSUNAGA and Yoshio ITO It is certified that error appears in the above-identified patent and that said Letters Patent are hereby corrected as shown below:

Col. 6, line 25; change "watersoluble" to ---water-soluble---.

Col. 6, line 32; change "Claim 5" to ---Claim 4---.

Col. 6, line 42; change "watersoluble" to ---water-soluble---.

Signed and Sealed this

Twenty-first Day of December 1976

[SEAL]

*Attest:*

RUTH C. MASON
*Attesting Officer*

C. MARSHALL DANN
*Commissioner of Patents and Trademarks*